United States Patent [19]

Donenfeld et al.

[11] Patent Number: 4,863,483

[45] Date of Patent: Sep. 5, 1989

[54] TEXTILE PRINTING AND DYEING: DYE LIQUOR OR PRINT PASTE CONTAINING WATER INSOLUBLE HEXA-METHOXY-METHYL-MELAMINE IN GLYCOL

[75] Inventors: Henry Donenfeld, Brighton; Eduard Lemanis, Keilor, both of Australia

[73] Assignee: BASF Australia Ltd., Melbourne, Australia

[21] Appl. No.: 95,327

[22] Filed: Sep. 10, 1987

[30] Foreign Application Priority Data

Sep. 10, 1986 [AU] Australia ..... PH07938
Nov. 19, 1986 [AU] Australia ..... PH09056

[51] Int. Cl.[4] ..... D06P 1/64; C07D 251/64; D06M 15/42

[52] U.S. Cl. ..... 8/496; 8/529; 8/532; 8/541; 8/542; 8/555; 8/557; 8/566; 8/580; 8/581; 8/594; 8/611; 8/918

[58] Field of Search ..... 8/496, 541, 566, 611

[56] References Cited

U.S. PATENT DOCUMENTS

| | | | |
|---|---|---|---|
| 3,390,114 | 6/1968 | Uhl et al. | 8/541 |
| 3,595,602 | 7/1971 | Oppelt et al. | 8/566 |
| 3,617,181 | 11/1971 | Beachem et al. | 8/566 |
| 4,210,412 | 7/1980 | Yamane et al. | 8/471 |
| 4,225,310 | 9/1980 | Acton et al. | 8/491 |
| 4,236,890 | 12/1980 | Blanchard et al. | 8/470 |
| 4,288,226 | 9/1981 | Abel | 8/496 |
| 4,299,592 | 11/1981 | Simenc et al. | 8/496 |
| 4,310,426 | 1/1982 | Smeltz | 252/8.8 |
| 4,417,898 | 11/1983 | Hasler et al. | 8/543 |
| 4,439,203 | 3/1984 | Runyon et al. | 8/496 |
| 4,484,927 | 11/1984 | Valenti | 8/496 |
| 4,511,707 | 4/1985 | Runyon et al. | 8/496 |
| 4,548,902 | 10/1985 | Hasler et al. | 8/496 |
| 4,576,610 | 3/1986 | Donenfeld | 8/471 |

FOREIGN PATENT DOCUMENTS

| | | |
|---|---|---|
| 250314 | 12/1987 | European Pat. Off. . |
| 2031029 | 4/1980 | United Kingdom . |

OTHER PUBLICATIONS

"Chemical Aftertreatment of Textiles" (edited by H. Mark et al.) (Wiley) 1971, pp. 165–168 and pp. 321–324.

*Primary Examiner*—A. Lionel Clingman
*Attorney, Agent, or Firm*—Irell & Manella

[57] ABSTRACT

A process is provided for direct coloring of textile fibres comprising appropriately pre-treating said fibres, preparing a solution of a cross-linking agent being a solution of a water insoluble technical hexamethoxymethyl melamine in a $C_{4-8}$ glycol, adding said solution of the cross-linking agent to a dye liquor or printing paste containing a colorant (excluding cationic dyestuffs) in the presence of an acid donor, applying the resultant mixture to said fibres and drying and curing said fibres.

Also provided is a dye liquor or print paste comprising a colorant (excluding cationic dyestuffs), an acid donor and a cross-linking agent being a solution of a water insoluble technical hexamethoxymethyl melamine in a $C_{4-8}$ glycol.

40 Claims, No Drawings

TEXTILE PRINTING AND DYEING: DYE LIQUOR OR PRINT PASTE CONTAINING WATER INSOLUBLE HEXA-METHOXY-METHYL-MELAMINE IN GLYCOL

This invention relates to textile printing and dyeing (hereinafter sometimes referred to as 'textile colouring' or 'colouring').

There are currently two common methods of textile printing, viz. direct and transfer paper printing. Of these two methods of printing, direct printing is by far the more prevalent form of printing because transfer paper printing is limited to certain synthetic fibres and their mixtures with cellulosic fibres and the effect of transfer paper printing is different from the character of conventional printing.

Direct colouring may take the form of pigment or soluble dyestuff colouring. As is well known, direct colouring with pigments as opposed to soluble dyestuffs, involves physically binding the pigments to the fibre surface using a binder, e.g. acrylic dispersion. Nowadays, pigment printing is preferred because of its ease of application e.g. the pigment preparations are incorporated in a printing emulsion containing water, thickener, emulsifier and various fixing agents, handle modifiers and, optionally, solvents such as white spirit, the resultant emulsion being printed onto the textiles, dried and heat cured.

The disadvantages of pigment colouring are the handle and the limited fastness to rubbing. Furthermore, the pigment colouring process when used in dyeing as opposed to printing has the further disadvantage of being limited to pale shades only, because of limitations in build-up and unsatisfactory rub-fastness properties, in depth generally above 2% by weight fabric (b.w.f.) pigment preparation on the fibre e.g. 20 g/l with 100% liquor pick up by weight of fabric.

Printing of synthetic/cellulosic fibre mixtures with soluble dyestuff mixtures has the disadvantage of high cost and/or poor reproducibility whilst dyeing with soluble dyes does not have the aforementioned disadvantage of reproducibility to the same extent as printing.

Printing with soluble dyestuffs requires lengthy processing, e.g. after printing and/or dyeing, the goods need to be steamed or heat cured to fix the dyestuffs and subsequently thickeners and unfixed dyestuffs and other unreacted reagents used need to be removed in a separate washing process. Similarly, conventional anti-migration agents and unfixed dyestuff and other unreacted agents need to be removed by washing from fabrics dyed by continuous dyeing processes with soluble dyes by conventional methods.

Furthermore, printing of fibre mixtures, e.g. synthetic/cellulosic fibre mixtures with soluble dyestuffs requires the application of two or more dyestuff types, specific for each fibre. Because of the different fixing procedures for each dyestuff class, the process normally suffers almost insurmountable disadvantages of high costs and/or poor reproducibility.

Accordingly, it is a principal objective of this invention to provide a process for direct colouring of textile fibres which combines substantially all the advantages of both pigment and dyestuff colouring, but substantially avoids the disadvantages of both types of direct colouring.

It is another objective of this invention to simplify the application, and particularly the selection, of pigments and dyestuffs to suit various textile fibres and mixtures thereof and hence to reduce the costs by reduction of inventory and capital costs.

According to one aspect of the invention, there is provided a process for direct colouring of textile fibres comprising appropriately pre-treating/cleaning said fibres by conventional methods, preparing a solution of a cross-linking agent being a solution of a water insoluble technical hexamethoxymethyl melamine, hereinafter referred to as "melamine" (see also attached Chemical Glossary of Trade Marks), in a $C_{4-8}$ glycol, adding said solution of the cross-linking agent to a dye liquor or printing paste containing a colourant, e.g. pigments or dyestuffs and mixtures thereof (excluding cationic dyestuffs) in the presence of an acid donor, applying the resultant mixture to said fibres and drying and curing said fibres.

The invention is applicable to a wide variety of fibres but the invention is of particular advantage and importance to fabrics consisting of 100% cellulosic fibres and their blends of synthetic fibres, e.g. cotton, cotton/-polyester and polyester/rayon blends.

Preferably, the amount of melamine, glycol and acid donor are in the ranges of 5 to 80 g/l (g/kg), 5 to 120 g/l (g/kg) and 1 to 100 g/l (g/kg) respectively based on the dye liquor or print paste. More preferably, the above amounts are 10 to 50 g/l and 15 to 50 g/l respectively for the melamine and the glycol.

It is essential that the melamine is water insoluble. As is well known, pure hexamethoxymethyl malamine is a water soluble substance at room temperature. To render the melamine water insoluble, it is slightly self-condensed.

By necessity, polycondensed mixtures of nuclear melamine are obtained, the complicated chemistry of which could be stated in a simplified form as follows:

Water insoluble melamine derivatives, such as penta/hexamethoxymethyl melamine (P/H MOMM), by necessity will be a mixture of polycondensed polynuclear melamine. As all N-methylol compounds are in equilibrium with their amines and free formaldehyde, there will always be a possibility for formation of free amino groups which may react with another N-methylol group and form a diaminal (uron) N-N'-methylene compound. N-methylol compounds are basically amino-semi-acetals and their methyl derivatives will be amino-acetals.

The commercial, at room temperature insoluble, melamine derivatives, described as essential for this invention (such as Luwipal* 066 and Cymel** 303), therefore, will be a mixture of insoluble poly-nuclear polycondensates, free formaldehyde, methanol and P/H MOMM.

** Trade Mark of AMERICAN CYANAMID COMPANY

In contrast to water soluble melamines (such as Luwipal* 068 and Kaurit* M70), which do not give satisfactory results in this invention, products such as Luwipal 066* are practically totally methylated (penta or hexa). In the presence of aqueous acid (below about pH 5), the methyl group can be split off; the product becomes soluble again and starts to react and condensate.

The production of such a poly condensed compound is well-known and is generally as follows:

Melamine is reacted or condensed with formaldehyde and converted to the acetal with methanol. In the presence of acid catalysts and in the absence of other functional groups such as those contributed by a color or fiber, it condenses with itself. Such a product is termed "technical" hexamethoxymethyl melamine and is commercially available. Generally, these mixtures comprise 50 to 70% by weight hexamethoxymethyl melamine and also contain its condensation products of 2 to 3 and up to 6 molecules of precondensed melamine. For instance, a typical mixture may contain about 60% by weight hexamethoxymethyl melamine, about 13% by weight of the 2 to 4 molecular condensate and about 26% of the 6 molecular condensate (e.g. Luwipal 066*).

Examples of $C_{4-8}$ glycols are 2-methyl-butane-1,4-diol, butane-1,2-diol, butane-1,3-diol, butane-1,4-diol and butane-2,3-diol, hexane-2,5-diol, pentane-1,5-diol and neopentyl glycol. Preferably, the glycols used are 2-methyl-pentane-2,4-diol, 2-methylpentane-1,5-diol and hexane-1,6-diol.

* Regd. Trade Mark of BASF AKTIENGESELLSCHAFT

For the dyeing of fibres, the acid donor is preferably one or more saturated aliphatic $C_{4-6}$ dicarboxylic acids and these are used in an amount of 1 to 5 g/l by volume of dyebath. Examples of these acids are succinic, glutamic and adipic acids, or commercially available mixtures thereof (e.g. Eulysin*S). Alternatively, an acrylic acid polymer or a heat saponifiable organic ester such as Eulysin* WP, can be used as acid donor.

For the preparation of print pastes, the acid donor is preferably a preparation of a high molecular weight acrylic acid homopolymer or copolymer with acrlyamide and is used preferably in an amount of 10 to 100 g/kg., more preferably 10–50 g/kg by weight print paste. Its primary function is however as a conventional thickener in the print pastes.

The process according to the invention, can be applied using dyestuffs or pigments, however, pigments, anionic dyes, vat dyes and disperse dyes are preferred (cationic dyestuffs generally do not work because of their cationic nature). It may be advantageous to use blends of different types of colourants, e.g. pigments with similar colour dyestuffs, to obtain improved yield and fastness properties.

Drying can be done separately from curing or preferably in one operation. The curing reaction is very fast provided the fibres can be dried very quickly. Generally, curing is in the temperature range to 220° C. for a period of 5 seconds to 4 minutes, preferably in the temperature range 180° to 210° for a period of fifteen to sixty seconds.

The dye liquor may contain further conventional additives, such as anti-foam agents (e.g. Leophen M*), dispersion agent (e.g. Setamol* WS), wetting agents (LEOPHEN M*) and anti-migration agents (e.g. Primasol* AMK). Often level dyeings are obtained particularly in the case of pigments without addition of conventional anti-migration

*Regd. Trade Mark of BASF AKTIENGESELLSCHAFT agents; therefore a separate dyring process in most cases is not necessary and the fabrics can be dried at curing temperatures. In fact, this is the preferred method.

The print pastes may, in addition, also contain conventional thickening agents. In the process of this invention, the thickening agents, e.g. polyacrylates, may act as the acid donor. Furthermore, agents may be added to the paste to improve the printing properties thereof e.g. diethylene glycol. Optionally, emulsifiers (e.g. Luprintol PE*) and solvents with low or no aromatic content may also be added.

*Regd. Trade Mark of BASF AKTIENGESELLSCHAFT

Advantageously, silicone oils and vegetable oils, optionally in the presence of urea, may also be added to the print paste to enhance further the rub fastness and soft handle.

It is preferred to use silicone oil which should be, preferably, between 1,000 to 15,000 cps (centipoise) and, more preferably, between 5,000 and 12,500 cps.

The preferred vegetable oil is castor oil (first pressing).

Preferably, the amount of silicone oil (optionally with urea) added to 1–100 g/kg print paste (each), but more preferably 10–60 g/kg print paste (each), and more preferably 20–35 g/kg print paste of silicone oil and 30–70 g/kg urea.

According to a further aspect of the invention, additions of small amounts of pigment binders are preferred and have a beneficial effect on the resultant fastness properties, particularly rub- and wash-fastness. The use of a binder is particularly beneficial for 100% cotton goods or their mixture, if they have not been sufficiently pretreated. Binders are also sometimes beneficially added for the purpose of preventing anionic dyestuffs staining white polyamide fibres during the first washing process. Accordingly, the use (e.g. 10 to 100 g/kg by weight print paste or dye liquor) of dispersions of cross-linked copolymers of acrylic acid ester, acrylonitrile, acrylic acid and N-methylol methyl acrylamide (Helizarin Binder* TW) were found to be beneficial.

In deep shades, 10 to 100 g/kg, by weight print paste or dye liquor, of binder was used, this having three further benefits:

(a) increase in rub fastness; and (b) assistance in fixation of the colourants on 100% cotton, especially if it is not well pretreated (purified); and (c) preventing staining of accompanying polyamide fibres during washing.

Interesting and very elegant, pleasing and useful print effects can be obtained by addition of silicate particles (e.g. Iriodin**) to the print paste. This effect can be further enhanced by curing the prints by heat calendering (e.g. under 2 to 5 tons pressure plus heat), instead of heat curing only.

**Regd. Trade Mark of MERCK DARMSTADT

According to another aspect of the invention, there is provided an improved dye liquor or print paste comprising a colourant (excluding cationic dyestuffs), an acid donor and a cross-linking agent being a solution of a water insoluble technical hexamethoxymethyl melamine in a $C_{4-8}$ glycol.

According to a further aspect of the invention, there is provided a cross-linking agent for use in combination with a dye liquor or print paste being a solution of a water insoluble technical hexamethoxymethyl melamine in a $C_{4-8}$ glycol.

According to yet a further aspect of the invention, in the case of the use of a high sublimation fast Red disperse dyestuff (e.g. Celestren* Red 2G, CI Disperse Red 346) the cross-linking agent may simply be a $C_{4-8}$ glycol In this situation, similar advantages and effects are obtainable to those in connection with the aforementioned cross-linking agent.

*Regd. Trade Mark of BASF AKTIENGESELLSCHAFT

According to another aspect of the invention, there is provided an improved print paste comprising a colourant (excluding cationic dyestuffs), one or more synthetic thickening agents, a cross-linking agent being a solution of a water insoluble technical hexamethoxymethyl melamine in a $C_{4-8}$ glycol and a silicone or vegetable oil, optionally in the presence of urea.

According to a further aspect of the invention, there is provided a composition for enhancing the handle, the rub resistance and water absorption of print pastes comprising a mixture of silicone oil and urea.

According to yet a further aspect of the invention, the improved print paste and resultant print properties can be obtained by dispersing the water insoluble technical hexamethoxymethyl melamine into the print paste (described above) without previously dissolving it in a $C_{4-8}$ glycol. In this case, the print paste composition is limited to containing, as a colourant, pigments or predominantly pigments. Thus, according to this aspect of the invention, there is provided a composition for enhancing the handle, the rub resistance and wet fastener properties of print pastes containing, as the colourant, pigments or predominantly pigments, and a mixture of silicone or vegetable oil and hexamethoxymethyl melamine (technical, water insoluble) e.g. Luwipal 066*.

*Regd. Trade Mark of BASF AKTIENGESELLSCHAFT

The $C_{4-8}$ glycols appear to have several functions:

(1) They dissolve and keep the melamine resin in solution.

(2) They provide hydroxyl groups for cross-linking with functional groups in the colourants, the melamine resin and the fibres.

(3) They can cross-link with the melamine forming the melamine acetal, which in turn can cross-link via the hydroxy groups in the cellulose with similar groups in the pigments or dyestuffs, depressing the swelling of the fibre.

(4) They improve the wet fastness, presumably by forming insoluble complexes with the dyestuffs and probably condensing with the hydroxyl groups in cotton, The resultant dyestuff particles seem to be present in highly crystallised form since quite goods yields and brillance are obtained. Similarly, the melamine resin reacts with various functional groups, e.g. hydroxyl, carboxyl, amide, sulpho, etc., commonly found in natural fibres, such as cotton, and various dyestuffs, e.g. anionic dyestuffs.

It will be clear from the above that the invention has the following advantages to offer to the user:

1. No wash-off necessary to remove unfixed dye bath impurities (saving of energy and capital), compared to conventional processes of dyeing and printing 100% cellulose or blends thereof with synthetic fibres by using conventional (non-pigment) dyestuff systems.

For example:

Disperse/Vat dyestuffs applied to PE/Cotton fabric PALANIL/INDANTHREN*

Disperse/Reactive dyestuffs applied to PE/Cotton fabric; PALANIL/BASILEN*

Reactant dyestuffs applied to PE/Cotton fabric; CELLESTREN*

2. No causticizing pretreatment for the textile fabric needed compared to some other dyestuff classes, in other processes. Faster processing, e.g. curing times which translates into capital saving.

3. Improved wet, light and rub fastness properties, compared to some other dyestuff classes and processes, e.g. compared to some direct dyestuffs, acid dyestuffs and pigments in deep shades, etc. Also the resistance to dry cleaning solvents is improved.

*Regd. Trade Mark of BASF AKTIENGESELLSCHAFT

4. Handle of fabric is at least comparable or improved relative to conventional pigment prints or dyeing.

5. Good definition of prints.

6. Applicable to wide variety of fabrics, i.e. quite non-fibre specific. Fibre reactive groups cross-link whilst fibres without such groups e.g. polyester, are bound by adhesion with the melamine derivative resin on the one hand and the insoluble dye complex on the other, e.g. salt formation with the melamine and cross-linking between dye, $C_{4-8}$ diols and melamine.

7. Non-staining or very little staining of polyamide or wool fabric during washing.

8. Faster curing at 180°-210° C. for as quick as 15 to 60 seconds.

9. Shorter fixation time in dry heat. This makes fixation by dry heat, e.g. stenter/hot flue, very economical. Compared to pigment printing, the invention has the following advantages:

(a) Improved fastness to rubbing in deep shades;

(b) Depending on the chemical nature of the dyestuff used, no binder or considerably smaller amounts of binder and acid donor are necessary.

It will further be appreciated from the above that the present invention provides a process which is more economical (Table I) than the prior art processes and which provides improved reproducibility. Furthermore, the colourants are most easily applied because only one colour type can be used on the fibre mixtures. Moreover, there are advantages for 100% cotton fabrics, namely more economical dyestuffs can be used as there can be freer selection of dyestuffs for their various properties, i.e. light fastness, dry cleaning properties etc., irrespective of what the intended original use for the dye was, i.e. dyes originally intended for completely other applications can now be used, to obtain highly desirable results, e.g. anionic dyestuffs originally intended to be used for the dyeing of leather can be used for dyeing and printing of 100% cotton.

From the above, it follows that:

Elegant combination of dyeing, printing, and finishing processes are possible (Table II and Example 12).

Deep shades can be dyed rub- and wash-fast utilizing the invention with most pigments; basically most organic pigments are suitable. Carbon black and iron oxide mixtures work also for production of dark brown shades. Carbon black works on its own for production of blacks.

Most colour depths can be obtained, wherein conventional pigment dyeing the depth is limited to approximately 2% pigment preparation by weight of fabric dyed.

High sublimation disperse dyes, e.g. Cellestren* when used in the invention, can be completely fixed, with heat, making further processing, such as washing rinsing and drying unnecessary.

Similarly, disperse and vat dye mixtures, e.g. Cottestren* can be fixed with heat alone by utilising the invention.

Anionic dyestuffs offer cost advantages in dark shades, particularly Eukesolar* liquid/Vialon*. In light shades pigments are used preferably for light fastness.

The wash fastness of direct dyes are improved.

*Regd. Trade Mark of BASF AKTIENGESELLSCHAFT

By using, in addition, the optional components of silicone or vegetable oil, optionally in the presence of urea, the following additional advantages are obtained:

1. The soft handle and the rub fastness is further improved.

2. The prints have improved absorbenzy.

3. Compared to conventional pigment prints, apart from the softer handle and superior rub fastness, also lesser amounts of binder dispersion are necessary. For example, in the invention, never more tham 100 g/kg print paste is necessary, whilst in conventional print paste up to 200 g/kg are being necessarily used, Even so, by conventional methods, one cannot obtain the same exceptionally high rub fastness properties, compared to the invention. Binders with low glass transition temperature can be used to advantage, resulting in particularly soft handles. These binders could not be used in conventional pigment printing in deep shades as the high amounts needed would result in "sticky" handle and poor rub fastness.

4. The invention is dieal for terry goods and delicate jersey knit goods, as well as for fibre blends such as acetate/cotton and Polyester/Rayon, however, it is of course applicable and shows advantages on all kinds of textile fibres.

5. The prints generally withstand 1000 rubs by the AASC crockmeter method, whilst the standard test method is 10 rubs.

The invention will now be described and illustrated in the following Examples which have been carried out, unless otherwise indicated, by the following general methods.

GENERAL METHODS**

*Regd. Trade Mark of BASF AKTIENGESELLSCHAFT
**The general methods of pre-treatment are by no means mandatory, as any soundly practised conventional pre-treatment method will suffice for the purpose of this invention.

Method I

Pretreatment I—for 100% cotton.

The loomstate cloths are saturated at 20°-30 ° with a liquor containing:

a detergent stable to alkalis e.g. Kieralon OL* : 6.6 g/l
a wetting agent eg. Leophen M*: 1.5 g/l
a Peroxide stabiliser and extraction agent prestogen EB: 21 g/l
Caustic Soda (46% solution): 70 ml/l
Hydrogen Peroxide 50%: 50 ml/l After saturation, the fabrics are squeezed to a pick up of approx. 80% b.w.f., rolled up into a batch, covered wityh polyethylene film and kept rolled for 16 hours. The fabric roll is then transferred to a jig machine and treated with the following chemicals:

Caustic soda (46%): 15 ml/l
oxidative starch degrading agent eg. Lufibrol O* 3 g/l
Kieralon OL: 2 g/l start running at 40° C., raise over one end to 95° C., run two ends at 95° C., rinse with water for two ends at 95° C., rinse with fresh water for two ends at 40° C., neutralise with cold water containing diarboxylic or carboxylic acids eg. Eulysin S to pH 6–8.

After this treatment, the fabrics should be reasonably free of sizing agents and impurities and should have a neutral to slightly acid pH value.

Method II

Pretreatment for 50/50 Polyester Cotton

Loomstate cloth, containing sizes, sighting colour and other impurities, is saturated with the following chemicals, liquor:

Alkali stable wetting agent eg. Leophen FK-1*: 7 g/l
Detergent, stable to alkali eg. Kieralon Ol: 3 g/l
Peroxide stabiliser eg. Prestogen K*: 10 g/l
Caustic soda (46%): 20 ml/l
Sodium silicate: 8 g/l
Oxidative starch degrading agent eg. Lufibrol O: 9 g/l
Hydrogen peroxide 50%: 44 ml/l

*Regd. Trade Mark of BASF AKTIENGESELLSCHAFT

After saturation, the fabric is squeezed to a pick up of 90% by weight fabric and steamed for 6 mins at 103°-105° C. in saturated steam, eg. Arioli steamer.

After steaming, the fabric is washed off in open width, through an open-width washing machine as follows:

1st Tank containing:
Sodium hydroxide flakes: 15 g/l
Kieralon OL: 6 g/l
Reductive extraction agent eg. Lufibrol KB*: 4 g/l
Bath temperature 98° C.:
*Regd. Trade Mark of BASF AKTIENGELLSCHAFT
2nd Tank containing:
Sodium hydroxide flakes: 10 g/l
Kieralon OL: 3 g/l
Lufibrol KB: 4 g/l
Bath temperature 98° C.
3rd Tank containing:
3 g/l Kieralon OL
Bath temperature 98° C.
4th Tank containing:
Water at 98° C.
5th Tank containing:
Water, set with Eulysin S to pH 4–5
6th Tank containing overflowing cold water.

Method III

Pretreatment for nylon/cotton/acetate

The loomstate fabric is desized on a jig machine with 1% solution of starch degrading enzyme at 60° C.; pH 5–6.

After 8 hours reaction, the fabric is washed in a winch machine with

Kieralon OL 2 g/l at 80° C. for 30 mins. followed by one rinse with water at 45° C., one rinse at room temperature.

The fabric is now ready for colouring according to invention.

Method IV

Preparation of cross linking agent solution

The indicated amount of tech. hexamethoxymethyl melamine is dissolved, by stirring at room temperature, into the indicated amount of a suitable diol (see p. 4). This solution is now ready for use.

Method V

Preparation of typical print paste

Into the prescribed amount of water (usually 600 to 800 g/kg) print paste emulsion is added by stirring at room temperature the prescribed amounts of:

Antifoam and/or wetting agent, plus optionally urea
Thickening agents
Handle modifying agents, e.g. silicone and vegetable oils and cross linking agent solution This mixture is homogenised by stirring at high speeds, e.g. 2,800 to 3,000 RPM, with a suitable mixing machine. Finally, the prescribed amount of binder dispersion is added by slow stirring—say 500 RPM.

To this mixture the prescribed amounts of colours are added by slow stirring. The paste is made ready for printing, by a final adjustment to constant printing viscosity, either by addition of electrolyte solution or additional thickening agent; and by straining through a mesh at least as fine as the finest screen used for printing.

Method VI

Preparation of conventional print paste for pigment printing on screen printing machines.

To the prescribed amount of water (usually 600–750 g/kg print paste) at room temperature, is added by stirring, the prescribed amounts of following ingredients:

Ammonia (32%)
Antifoam
Thickeners
Handle modifiers and emulsifying emulsion
Yield improving agents
½ of the prescribed amount of binder dispersion.

Into this mixture is emulsified at high speed 2800–3000 RPM, the prescribed amount of solvent eg. white spirit.

Finally, the second half of binder dispersion is added under slow stirring.

To this preparation the prescribed amounts of colours are added by slow stirring; the printpaste is ready for printing after adjusting to a constant printing viscosity, either by addition of electrolyte solution or additional thickening agents, and after straining through a mesh at least as fine as the finest screen used in printing.

Method VII

Preparation of padding liquor.

To a smaller than prescribed amount of water, at room temperature erature 25°–30° C., are added by stirring the prescribed amounts of following ingredients:

Wetting Agent (non foaming)
Cross linking agent solution
Acid donor
Binder dispersion
Colour The mixture is adjusted to the prescribed volume with water and stirred until homogeneous. It is strained into a padding through, through a fine sieve or cloth.

EXAMPLE 1

A. Printing with 1:2 metal complex anionic disperse dyestuff (Method I, II respectively for preparation; IV and V for print paste preparation)

1,000 g of dyestuff printing paste was first prepared by mixing the following materials:

| | |
|---|---|
| Water | X g (variable) |
| Mixture of Acid Violet CI 12196 and Acid Blue CI 12195 (EUKESOLAR** Navy R conc. liquid) | 20 g |
| Tech. Hexamethoxymethyl Melamine (CYMEL 303*) | 10 g |
| 2-methyl pentane-2,4-diol | 20 g |
| Polyacrylic Printing Binder (Helizarin Binder TW) | 30 g |
| Dicarboxylix acids (EULYSIN S) | 2 g |
| Polyacrylic thickener (LUTEXAL HP**) | Y g (variable) |
| | 1000 g |

*Trade Mark of AMERICAN CYANAMID COMPANY
**Regd. Trade Mark of BASF AKTIENGESELLSCHAFT The above print paste composition was then applied to 100% cotton and to 50/50 polyester cotton fabric through a flat screen of 50 mesh using a magnetic roller squeegee on a J. Zimmer flat bed printing machine, dried at 60° C. and then cured for 3–4 minutes at 170° C. or, alternatively, 15–60 seconds at 190° C., no wash-off being necessary.

B. Dyeing with 1:2 metal complex anionic disperse dyestuff

The same process as described for printing was used except that the following composition (1,000 g) was first prepared as a padding liquor: (Method VII)

| | |
|---|---|
| Water | 749 g |
| Mixture of Acid Violet CI 12196 and Acid Blue CI 12195 (EUKESOLAR Navy R conc. liquid) | 25 g |
| Non-foaming wetting agent (LEOPHEN M | 1 g |
| Polyacrylic Printing Binder (Helizarin TW) | 15 g |
| Tech. Hexamethoxymethyl Melamine (CYMEL 303) | 10 g |
| 2-methyl pentane-2,4-diol | 40 g |
| dicarboxilic acids (EULYSIN S) | 2 g |
| | 1000 g |

The above padding liquor was applied at 25° C. on a cotton and polyester cotton fabric, 70% pick up; dried and cured like the print (see above).

Good to very good fastness properties to light, washing and rubbing (wet and dry) were obtained.

EXAMPLE 2

The following print paste was prepared as in Example 1 (Methods IV, V):

| | |
|---|---|
| Water | 731 g |
| Ammonia | 3 g |
| Anti foaming agent (DEFOAMER TP*) | 3 g |
| LUTEXAL HP | 63 g |
| 2-methyl pentane-2,4-diol | 15 g |
| Tech. Hexamethoxymethyl Melamine (CYMEL 303) | 15 g |
| Helizarin Binder TW | 100 g |
| Acid Black CI63 (EUKESOLAR Black R conc. liquid) | 24 g |
| EUKESOLAR Navy Blue R conc. liq. | 36 g |
| Acid Red CI226 (EUKESOLAR Red G) | 5 g |
| EUKESOLAR Yellow G | 5 g |
| | 1000 g |

20 meters of Cotton sheeting cloth was printed with the above formulation on a flat bed BUSER printing machine, using a 80 mesh screen, dried at 110° C. and crease resist finished by foam application of a crease resist glyoxal urea formaldehyde resin e.g. FIXAPRET TX 205* and cured on a stenter for 11 seconds at 190° C.; running speed 76 m/min.

The following composition was used for the foam resin application, through a Stork rotary screen applicator:

| | |
|---|---|
| Water | 761 g |
| Acetic acid 90% | 2 g |
| Polyethylene emulsion, e.g. Perapret PE 240* | 60 g |

-continued

| | |
|---|---|
| Fixapret TX 205 | 165 g |
| Nekanil* TC 129 (non-ionic surface active, foaming agent) | 10 g |
| Lutensit* TC KD (anionic surface active, foaming agent) | 2 g |
| | 1000 g |

*Regd. Trade Mark of BASF AKTIENGESELLSCHAFT

25% application b.w.f.

EXAMPLE 3

Blue and Black prints were produced with a print paste prepared as in Example 1, as follows:

| | |
|---|---|
| Water | X g (variable) |
| Lutexal HP | 50 g |
| Diethylene Glycol | 10 g (to improve running properties) |
| 2-methyl Pentane-2,4-diol | 15 g |
| Tech. Hexamethoxymethyl Melamine (CYMEL 303) | 10 g |
| Eukesolar conc. liquid | (variable) |
| | 1000 g |

Blue: 5 g/kg Eukesolar Navy R conc. liquid, 15 g/kg Luconyl Blue 679 (Aqueous dispersion of Pigment Blue 15)

Black: 70 g/kg Eukesolar Black R conc. liquid. The above compositions were printed, dried, heat fixed at 190° C., 76 m/min. (cease resist foam finished as in Example 2), 11 sec. dwell time. Various other dark prints were produced in this way, e.g. royal blue, dark blue, dark brown, black on 100% cotton and 50/50 PE/cotton fabric.

EXAMPLE 4

Brown Print with 1:2 metal complex anionic disperse dyestuff

Paste prepared as in Example 1:

| | |
|---|---|
| Water | 699.4 g |
| Defoamer* TP 10% solution | 10 g |
| Diethylene glycol | 20 g |
| Ammonia 32% (10% solu.) | 50 g |
| Lutexal HP | 50 g |
| Helizarin Binder TW | 100 g |
| 2-methyl pentane-2,4-diol | 15 g |
| Tech. Hexamethoxymethyl Melamine (CYMEL 303) | 15 g |
| Eukesolar Red G' conc. liquid | 17 g |
| Eukesolar Yellow RL liquid (Acid Yellow CI119) | 4 g |
| Eukesolar Black RL conc. liquid | 18 g |
| Eukesolar Navy Blue RL conc. liquid | 1.6 g |
| | 1000 g |

*Regd. Trade Mark of BASF AKTIENGESELLSCHAFT

Printed and dried as in Example 1 on 100% cotton and 50/50 polyester cotton fabric and cured for 60 seconds at 190° C.

EXAMPLE 5

Printing with 1:2 metal complex, water soluble anionic dyestuffs 1000 g print paste was prepared with the following composition:

| | |
|---|---|
| Water | 720 g |
| 1:2 metal complex dyestuff (Ortolan* Black RL (Acid Black CI 63) | |
| or Ortolan* Brown 3R (Acid Brown) | 30 g |
| 2-methyl pentane-2,4-diol | 30 g |
| Tech. Hexamethoxymethyl Melamine (Luvipal 066) | 30 g |
| Polyacrylic Thickeners (Lutexal HP) | 80 g |
| and Lutexal HVW) | 10 g |
| Polyacrylic Dispersion Printing Binder | 100 g |
| Helizarin Binder TW | |
| | 1000 g |

*Regd. Trade Mark of BASF AKTIENGESELLSCHAFT

The composition was printed, dried and cured as in Example 1.

EXAMPLE 6

Print on 100% and 50/50 polyester/cotton fabric with 1:2 metal complex disulphonate dyestuff Print paste was prepared and printed as in Example 1, but with the following composition:

| | |
|---|---|
| Water | 700 g |
| Lutexal HP | 60 g |
| Helizarin Binder TW | 100 g |
| 2-methyl pentane-2,4-diol | 15 g |
| Tech. Hexamethoxymethyl Melamine | 15 g |
| Silicone oil** 200/12500 | 40 g |
| Liquid paraffin | 40 g |
| 1:2 metal complex disulphonate-Acid Red CI357 (Acidol Scarlet M-L*) | 30 g |
| | 1000 g |

*Regd Trade Mark of BASF Aktiengesellschaft
**Also known as "Siloxane 200/12500" manufactured by DOW CORNING.

EXAMPLE 7

Printing and Dyeing with Disperse Dyestuff on 100% cotton and 50/50 polyester cotton fabric A. Printing was effected as in Example 1, with the following print paste composition:

| | |
|---|---|
| Water | 715 g |
| Lutexal HP | 60 g |
| Helizarin Binder TW | 150 g |
| Diethylene Glycol | 20 g |
| 2-methyl pentane-2,4-diol | 15 g |
| Tech. Hexamethoxymethyl Melamine | 10 g |
| Disperse yellow CI 213 (Cellestren Yellow 5G) | 30 g |
| | 1000 g |

Printing and curing was carried out for 60 seconds at 190° C. (no predrying).

B. Dyeing

The following padding liquor was prepared (Method VIII):

| | |
|---|---|
| Water | 834 g |
| Leophen M | 1 g |
| 2-methyl pentane-2,4-diol | 90 g |
| Tech. Hexamethoxymethyl melamine | 15 g |
| Helizarin Binder TW | 20 g |
| Eulysin WP | 10 g |
| Cellestren Yellow 5G' | 30 g |
| | 1000 g |

The above liquor composition was applied to produce a 65% pick-up by weight of fabric on 100% cotton and 50/50 polyester/cotton fabric; curing for 60 seconds at 190° C.

EXAMPLE 8

Dyeing on 100% cotton and 50/50 polyester/cotton fabric with a red disperse dye

A pad dyeing was carried out as in Example 7B, with the following pad liquor:

| | |
|---|---|
| Water | 699 g |
| Leophen M | 1 g |
| 2-methyl pentane-2,4-diol | 120 g |
| Tech. Hexamethoxymethyl Melamine | 60 g |
| Eulysin WP | 10 g |
| Secondary Dispersion of Polyethylene Wax (PERAPRET PE 240*) | 30 g |
| Cellestren Red 2G' | 80 g |
| | 1000 g |

*Regd Trade Mark of BASF Aktiengesellschaft

EXAMPLE 9

Printing and dyeing with aqueous pigment dispersions

A. A print paste was prepared and printed on 100% cotton sheeting; 50/50 polyester/cotton and 65/35 polyester cotton; as in Example 1 with the following print paste:

| | |
|---|---|
| Water | 805 g |
| Lutexal HP | 30 g |
| Silicone oil 200/12500 | 50 g |
| Helizarin Binder TW | 50 g |
| Tech. Hexamethoxymethyl melamine | 15 g |
| Aqueous Dispersion of Pigment Red (Helizarin Red GR) | 50 g |
| | 1000 g |

B. Dyeing with an aqueous pigment dispersion
The following pad liquor was prepared:

| | |
|---|---|
| Water | 835 g |
| Leophen M | 1 g |
| 2-methyl pentane-2,4-diol | 90 g |
| Tech. Hexamethoxymethyl melamine | 10 g |
| Anti-migration agent e.g. Vitexal PFA* | 2 g |
| Eulysin S | 2 g |
| Helizarin Red GR | 60 g |
| | 1000 g |

*Regd Trade Mark of BASF Aktiengesellschaft

Padded at 25° C. and 65% pick-up; curing for 60 seconds at 190° C.

EXAMPLE 10

Print on 50/50 Polyester/Cotton with 1:2 metal complex sulphonamide dyestuff, combined with 1:2 metal complex disperse dyestuff A print paste was prepared and printed as set out in the General Methods with the following composition:

| | |
|---|---|
| Water | 805 g |
| Lutexal HP | 50 g |
| Diethylene glycol | 10 g |
| 2-methyl pentane-2,4-diol | 30 g |
| Tech. hexamethoxymethyl melamine | 30 g |
| Eulysin WP | 5 g |

-continued

| | |
|---|---|
| Acid Red CI 226 (Eukesolar Red G conc.) | 10 g |
| Acid yellow CI 119 (Eukesolar Yellow R) | 10 g |
| Acid Blue/Violet Mix (Ortolan N.Blue BR) | 40 g |
| | 1000 g |

Printed on Zimmer magnetic table with 50 mesh flat screen and then cured 60 seconds at 190° C.

EXAMPLE 11

Print with aqueous pigment dispersion, combined with disperse dye (General Methods I, II, III respectively, IV and V).

Print on 100% cotton, 50/50 polyester cotton and 50/50 acetate/cotton fabric were prepared, printed and cured as in Example 10 with the following composition:

| | |
|---|---|
| Water | 765 g |
| Lutexal HVW | 10 g |
| Lutexal HP | 40 g |
| Helizarin Binder TW | 80 g |
| Diethylene glycol | 10 g |
| 2-methyl pentane-2,4-diol | 20 g |
| Tech. Hexamethoxymethyl melamine | 20 g |
| Eulysin WP | 5 g |
| Aqueous dispersion of pigment green CI 36 (Luconyl green 915*) | 40 g |
| Disperse Yellow CI 213 (Cellestren yellow 5G) | 10 g |
| | 1000 g |

EXAMPLE 12 (General Methods I, II, IV, VI and VII)

Combined dyeing/printing and finishing process technique, on 100% cotton and 50/50 polyester cotton light weight sheeting fabrics. A "TAUPE" and a "COCOA" shade was produced.

A. A padding liquor was prepared as in Example 9B, with the following composition:

| | |
|---|---|
| Water | 911.5 g |
| Leophen M | 1 g |
| 2-methyl pentane-2,4-diol | 40 g |
| Tech. Hexamethoxymethyl Melamine | 10 g |
| Eulysin S | 20 g |
| Vitexal PFA | 2.5 g |
| Helizarin Binder TW | 15 g |
| | 1000 g |

To two lots of 100 liters, each of this padding liquor, the following colour composition was added:

| Aqueous Dispersions of: | Taupe | Cocoa |
|---|---|---|
| Pigment Red (cf. Table III) (Helizarin Pink BT) | 0.16 g | 0.87 g |
| Pigment Yellow 83 (Helizarin brilliant yellow RRT) | 0.36 g | 0.62 g |
| Helizarin Dk. Brown TT (mixture of carbon black & iron oxide) | 1.36 g | 7.5 g |
| Padding Liquor | 1000 g | 1000 g |

2 lots of fabric were padded with each formation respectively, to 60% pick up, through a Kuesters pad mangle; the pad dyeings were pre-dried to 12% residual moisture, by infra red radiation.

Both fabrics were overprinted with the following pigment print pastes:

| | |
|---|---|
| Water | 630 g/kg-803 g/kg |
| Ammonia 32% | 2 g/kg-2 g/kg |
| Anti foam B (1:1 water) | 2 g/kg-2 g/kg |
| Lutexal HP | 26 g/kg-24 g/kg |
| Emulsion FK 8520* | 50 g/kg-40 g/kg |
| Luprimol** CW(colour intensifier) | 30 g/kg-24 g/kg |
| White spirit | 100 g/kg-45 g/kg |
| Helizarin Binder TW | 150 g/kg-50 g/kg |
| Alginate thickener 5% solution | 10 g/kg-10 g/kg |

*Manufactured by BASF AUSTRALIA LTD.
**Regd. trade mark of BASF AKTIENGESELLSCHAFT Two designs, Gallery and Heathcote respectively, were printed with 7 and 3 colourways respectively containing various amounts (from 100 g/kg to 1.5 g/kg), of combinations selected from two or more aqueous pigment dispersions, from the following range: HELIZARIN Black HDT, Blue RT, Red BBT, Voilet RFKI, Yellow RRT, green BT, scarlet B, Blue BT, Dark Brown TT.

A Buser flat bed machine using 60 and 80 mesh screens at 25 m/min. running speed was used.

The prints were dried at 110° C. 20 seconds; they were then coated with a crease resist foam containing a standard glyoxal urea formaldehyde resin formulation (Fixapret TX205*) (Method VII) through a Stork rotary screen and cured through a stenter at 190° C. for 11 seconds, running speed 76 m/min. Thus, the ground dyed shade, the print and the cease resistant finish was cured in one operation.

The following fastness properties were obtained:

| | | COCOA**/GALLERY** | | | | TAUPE**/HEATHCOTE** | | | |
|---|---|---|---|---|---|---|---|---|---|
| | | poly/cotton | | cotton | | poly/cotton | | cotton | |
| Light | | 7 | | 6 | | 7 | | 6 | |
| Rub | Dry | 4 | | 4 | | 4/5 | | 4/5 | |
| | Wet | 3/4 | | 3(print) | | 4/5 | | 4/5 | |
| | | dyeing/print | | dyeing/print | | dyeing/print | | dyeing/print | |
| Machine Wash Domestic Detergent | | | | | | | | | |
| 1 × wash | 4/5 | 4/5 | 4/5 | 4/5 | 4/5 | 4/5 | 4/5 | 4/5 | |
| 5 × wash | 4, | 4/5 | 3 | 4/5 | 4/5 | 4/5 | 3 | 4/5 | |
| Industrial Detergent Kieralon OL plus soda ash × 5 washes | | | 4 | 4/5 | | | 4/5 | 4/5 | |

**Trade/brand names of Sheridan Textiles (formerly Division of Pacific Dunlop Limited).

These fastness properties were considered above average for domestic sheeting fabrics widely sold in Australia.

EXAMPLE 13

A print was produced, as in Example 10, using the following composition:

| | |
|---|---|
| Water | 717 g |
| Ammonia | 5 g |
| Antifoam* B | 29 g |
| Lutexal HD | 24 g |
| Luvipal 066 | 10 g |
| 2 methyl Pentane-1,5 diol | 80 g |
| Silicone Oil 200/12500** | 40 g |
| Helizarin Binder TW | 45 g |
| Cellestren Red 2G | 35 g |
| Helizarin Red GR | 15 g |
| | 1000 g |

EXAMPLE 14

The following standard formulation was used to check behavior of a variety of colourants, when applied to 100% cotton, by padding to 60% pick up and curing for 60 seconds at 200° C.

| Colourant | Xg(variable) |
|---|---|
| Tech. Hexamethoxymethyl melamine (Luvipal 066) | 30 g |
| 2-methyl pentane-1,5 diol alternatively | 45 g |
| 2-methyl pentane-2,4 diol alternatively | 45 g |
| Hexane-1,6-diol | 45 g |
| Leophen M | 1.2 g |
| Eulysin S' | 2.5 g |
| Helizarin Binder TW | 20 g |
| | 1000 g |

*Marketed by BASF AUSTRALIA
**DOW CORNING AUSTRALIA

The dyeings were soaped with an industrial detergent e.g. 2 g/l Kieralon B* for 10 min at 100° C., Rinsed and dried and tested for fastness properties.

*Regd. trade mark of BASF AKTIENGESELLSCHAFT

The following properties were found (unless otherwise indicated, the glycol used was 2-methyl-1,5-diol):

| | Light Xeno-test | Wash Test ISO[3] (a) | (b) | (c) | Solvent perchlor (a) | (b) | (c) | Rubbing dry | wet |
|---|---|---|---|---|---|---|---|---|---|
| 5 g/l Helizarin Brilliant Pink BT | >6 | 4-5 | 5 | 4 | 4-5 | 4-5 | 5 | 4 | 4 |
| soaped 5 g/l Helizarin | >6 | 4-5 | 5 | 4-5 | 4-5 | 4-5 | 5 | 4 | 3-4 |

-continued

| | Light Xeno-test | Wash Test ISO[3] (a) | (b) | (c) | Solvent perchlor (a) | (b) | (c) | Rubbing dry | wet |
|---|---|---|---|---|---|---|---|---|---|
| Brilliant Yellow RRT | >6 | 4–5 | 5 | 4–5 | 4–5 | 4–5 | 5 | 3–4 | 3–4 |
| soaped | >6 | 4–5 | 5 | 4–5 | 4–5 | 4–5 | 5 | 3–4 | 3–4 |
| 5 g/l Helizarin | | | | | | | | | |
| Dark Brown TT | >6 | 3–4 | 4–5 | 4–5 | 4 | 4–5 | 5 | 4 | 3–4 |
| soaped | >6 | 4 | 4–5 | 4–5 | 4–5 | 4–5 | 5 | 4 | 3–4 |
| 5 g/l Helizarin | | | | | | | | | |
| Dark Brown TT | | | | | | | | | |
| soaped | >6 | 4 | 4–5 | 4–5 | 4 | 4–5 | 5 | 4 | 3–4 |
| (2,4-diol) | >6 | 4 | 4–5 | 4–5 | 4–5 | 4–5 | 5 | 4 | 3–4 |
| 5 g/l Helizarin | | | | | | | | | |
| Dark Brown TT | | | | | | | | | |
| soaped | >6 | 4 | 4–5 | 4–5 | 4 | 4–5 | 5 | 4 | 3–4 |
| (1,6-diol) | >6 | 4–5 | 4–5 | 4–5 | 4–5 | 4–5 | 5 | 3–4 | 3 |
| 30 g/l Cellestren | | | | | | | | | |
| Blue GG | 5 | 4–5 | 4–5 | 4–5 | 2 | 4 | 4–5 | 2–3 | 2–3 |
| soaped | 5–6 | 4–5 | 4–5 | 4–5 | 2–3 | 4 | 4–5 | 2–3 | 2–3 |
| 50 g/l Indanthren | | | | | | | | | |
| Blue GCD | >6 | 4 | 4–5 | 4–5 | 4 | 4–5 | 5 | 3 | 3 |
| soaped | >6 | 4–5 | 4–5 | 4–5 | 4 | 4–5 | 5 | 3 | 3 |
| 75 g/l Eukesolar | | | | | | | | | |
| Black R liquid | 4 | 4 | 4–5 | 2 | 4–5 | 3–4 | 4–5 | 4 | 3 |
| soaped | 4 | 3 | 4–5 | 1–2 | 4 | 3 | 4–5 | 4 | 2–3 |

Notes:
Light fastness is measured on scale 1–8 (8 being the best)
(a) = change of shade on scale 1–5 (5 being the best)
(b) = staining of cotton on scale 1–5 (5 being the best)
(c) = staining of wool on scale 1–5 (5 being the best)> means greater than

EXAMPLE 15

Dyeing with disperse dyestuff (as per Example 1B but with no hexamethylene melamine) on 100% cotton and 50/50 polyester cotton.

| | |
|---|---|
| Water | 669 g |
| Leophen M | 1 g |
| Primasol AMK | 20 g |
| Perapret PE 2/40 | 30 g |
| 2-methyl pentane 2,4-diol | 200 g |
| Cellestren Red 2G | 80 g |
| | 1000 g |

Pad 65% pick up; dry 60° C.; cure 60 seconds at 200° C.

EXAMPLE 16

Printing with solvent dyes

A print paste was prepared according to the general method V except that the solvent dyes were always predissolved in cyclohexane.

| | |
|---|---|
| Water | 728 g |
| Lutexal HP | 30 g |
| Helizarin Binder TW | 100 g |
| 2-methyl pentane-2,4-diol | 15 g |
| Tech. Hexamethoxymethyl melamine (CYMEL 303) | 15 g |
| Solvent Blue CI 21 (Oracet Blue*) | 1.25 g |
| Solvent Black CI 6 (Savinyl Black BN**) | 7 g |
| Solvent Brown CI 28 (Savinyl Brown GLS**) | 0.6 g |
| Solvent Red CI 122 (Neozapon Red GE***) | 0.6 g |
| Cyclohaxanone | 100 g |

-continued

| | |
|---|---|
| | 1000 g |

Printed, dried and cured as in Example 1.
*Reg Trade Mark of Ciba/Geigy
**Reg Trade Mark of Sandoz.
***Reg Trade Mark of BASF Aktiengesellschaft.

EXAMPLE 17

As Example 16 except that for the colourants the following composition was used

Aqueous Dispersion of Pigment Yellow CI 2.5 g/kg print/paste (Luconyl yellow 098***)

Solvent Blue CI 38 2.5 g/kg print/phase (Savinyl Blue 3GLS'**)

EXAMPLE 18

An improved colourant range is produced by (a) mixing various selected colourants together (e.g. 450 g CI Pigment Red 112 preparation plus 50 g Disperse Yellow 213) at room temperature;

(b) Mixing separately, at room temperature, 475 g silicone oil 200/12500** and 25 g hexamethoxymethyl melamine (technical water insoluble), resulting in a very smooth paste, which is then added to mixture (a) and the components are then mixed together at room temperature resulting in colour (c).

Varying amounts of colour (c) are then added to a print paste containing:

50 g/kg urea x g/kg thickener e.g. Lutexal HP* (variable)

20–100 g/kg Acrylic Binder dispersion (e.g. Helizarin Binder TW*)

9 g/kg Hexamethoxymethyl melamine (technical insoluble) (e.g. Luwipal 066*)

1–35 g/kg Silicone oil 12/12,500 y g/kg water (variable)

Total—1000 g

* Regd. Trade Mark of BASF AKTIENGESELLSCHAFT
** Made by DOW CORNING

EXAMPLE 19

Preparation of a typical colourant, provisional termed "Donanthren Yellow GC"

| | |
|---|---|
| Pigment Yellow 16 | 4000 g |
| Disperse Yellow 213 | 1000 g |
| Silicone oil 200/12500 | 4750 g |
| Hexamethoxymethyl melamine (technical, water insoluble) | 250 g |
| (Luwipal 066) Total | 10000 g |

The above ingredients were mixed together by simple stirring at room temperature until a homogeneous product was obtained. This composition is now ready for use in print pastes as the "colourant".

EXAMPLE 20

A product, provisionally termed Product XPG, is prepared by stirring together at room temperature, until homogeneous,

| | |
|---|---|
| 9800 g | of hexamethoxymethyl melamine (technical, water insoluble) (Luwipal 066) and |
| 200 g | of silicone oil 200/12500 |
| Total 10000 g | |

This composition can be used as an additive to print paste to enhance the softness of handle, the rub resistance and wet fastness properties of said print paste.

EXAMPLE 21

1 kg yellow print paste was produced by blending together at room temperature with a variable speed stirrer (0–3000 RPM) the following ingredients:

| | |
|---|---|
| Water | 750 g |
| Polyacrylic thickner (Lutexal HP) | 40 g |
| Urea | 60 g |
| Helizarin Binder TW | 100 g |
| Product XPG (Example 20) | 10 g |
| Yellow colourant as in Example 19 | 40 g |
| Total | 1000 g |

This paste was printed on 100% cotton fine woven fabric, 65/35 polyester/rayon, 50/50 polyester/cotton, nonchlorinated wool, polyester/cotton/lycra knitted fabric and 100% cotton towelling, through an 80 mesh flat bed screen, on a Zimmer magnetic squeegee table, dried at 100° C. and cured at 190° C. for 60 seconds. ISO wash test 3 gave a rating of 4–5 and standard rub test by crock meter 10 rubs was 5.

EXAMPLE 22

1 kg Black Print Paste

The following composition was blended together at room temperature, by stirring, until a homogenous paste was obtained:

| | |
|---|---|
| Water | 717 g |
| Polyacrylic Thickener (Lutexal HP) | 40 g |
| Urea | 60 g |
| Helizarin Binder TW | 100 g |

-continued

| | |
|---|---|
| Silicone 200/12,500 | 35 g |
| Hexamethoxymethyl melamine (technical, water insoluble) (Luwipal 066) | 10 g |
| Helizarin Black HDT | 20 g |
| Helizarin Blue RT | 9 g |
| Helizarin br.Red BBT | 4 g |
| Cellestren* Yellow 5G | 5 g |
| | 1000 g |

This paste was printed on 100% cotton, and 65/35 polyester/rayon fabrics, through a 80 mesh flatbed screen, on a Zimmer magnetic squeegee table, dried at 100° C. and cured at 190° C. for 60 seconds.

EXAMPLE 23

The same procedure was used as in Example 21 but using the following colours:

(A) 45 g/kg Aqueous preparation of Pigment Yellow 16 5 g/kg Disperse Yellow 213

(B) 23 g/kg Aqueous preparation of Pigment Orange 34 2 gm/kg Disperse Yellow 213

(C) 25 g/kg Aqueous preparation of Pigment Red 146 20 g/kg Aqueous preparation of Pigment Yellow 83 5 g/kg Disperse Yellow 213

(D) 25 g/kg Aqueous preparation of Pigment Blue 15:3 20 g/kg Aqueous preparation of Pigment Blue 15:1 5 g/kg Aqueous preparation of Pigment Violet 23

(E) 10 g/kg Aqueous preparation of Pigment Blue 15:3 10 g/kg Aqueous preparation of Pigment Green 36

(F) 25 g/kg Aqueous preparation of Pigment Green 36 25 g/kg Aqueous preparation of Pigment Green 7

(G) 45 g/kg Aqueous preparation of Pigment Violet 23 5 g/kg Cellestran Red 2G*

(H) 10 g/kg Aqueous preparation of CI Pigment Yellow 83 12.5 g/kg Aqueous preparation of CI Pigment Black 1 18.8 g/kg Aqueous preparation of CI Pigment Blue 15:1 10 g/kg Aqueous preparation of CI Pigment Red 146

All gave the same good fastness properties as in Example 21.

EXAMPLE 24

1 kg matt white print paste, suitable to be printed on coloured ground shades, was prepared by blending together the following ingredients:

| | |
|---|---|
| Water | 555 g |
| Polyacrylic thickener (Lutexal HP) | 40 g |
| Acrylic Binder Dispersion (Helizarin Binder TW) | 150 g |
| Silicone oil Siloxane DC 200/12500 | 50 g |
| Hexamethoxymethyl melamine (Luwipal 066) | 5 g |
| Aqueous preparation of rutile Titanium Dioxide eg. Helizarin white RFK1 | 200 g |
| Total | 1000 g |

This paste was printed dried and cured as in Example 21, but on 50/50 polyester/cotton sheeting fabric. The same good fastness properties were obtained.

EXAMPLE 25

The same procedure was used as in Example 21 but using the following formulation:

| | |
|---|---|
| Water | 685 g |

-continued

| | |
|---|---|
| Urea | 60 g |
| Thickener (Lutexal HP) | 40 g |
| Hexamethoxymethyl melamine (technical, water insoluble) (Luwipal 066) | 10 g |
| Hexylene glycol | 30 g |
| Silicone oil 200/12500 | 35 g |
| Helizarin Binder TW | 100 g |
| Disperse Yellow 213 | 30 g |
| Pigment Red 146 | 10 g |
| Total | 1000 g |

The same good fastness properties as in Example 21 were obtained.

Very soft prints with very good fastness properties were obtained.

All the materials produced in the above examples (for which detailed fastness figures are not provided) were tested, with emphasis on light, rubbing and wash fastness and assessed virtually.

The following methods, issued by the Standards Association of Australia, were used to test all the samples (except No. 14):

| | |
|---|---|
| light fastness | AS 2001.4.21 (MVTF lamp) |
| rub fastness | AS 2001.4.3 (10× and 100× extended rubbing) |
| washing | AS 2001.4.15 |
| also | ISO 3 (International Standards Organization) |
| dry cleaning | AS 2001.4.16 |

The materials produced in Example 14 were tested according to the Internal Standards Organization specifications. (It is to be noted that the AS standards are based on the ISO specifications but adapted to be more stringent climatic conditions prevailing in Australia and required particularly for meeting Government contracts requirements).

* Regd. Trade Mark of BASF AKTIENGESELLSCHAFT

In all cases the materials tested at least met and often surpasses commercial standard requirements as practised in Australia, Europe, U.S.A. and other developed markets.

EXAMPLE 26

COMPARATIVE EXAMPLE—Illustrating Processing Advantages

Dyeing or printing of PE/Cotton with disperse and VAT dyes/compared to Invention

| Typical Process | Invention |
|---|---|
| Pre-Treatment | |
| Desizing | Desizing |
| Caustic Extraction (optional) | Not required |
| Bleaching | Bleaching |
| Washing | Washing |
| Drying | Drying |
| Dyeing | |
| Pad Vat and Disperse Dyes | Pad dyestuff and cross linking agents, etc. |
| Dry | *Dry |
| Heatfix, say 60 sec. 210° C. | Heatfix, say 3–4 minutes, 170° C., or 5–60 sec., 190° C.–210° C. or H.T-steam, say, 10–15 min. 185° C. |
| Pad with NaOH and Hydrosulphite | |
| Steam, say 60 seconds 102° C. | |
| Rinse, oxidize, soap, rinse | |
| Dry | |

*Optional, but precautions should be that excess liquor is removed and does not cause migration/sagging.

Printing by conventional process

Similar to dyeing, but specialised steamer (Flash Ager) required—not available or not installed in Australia at present. With the invention, however, no such specialised machinery is needed.

EXAMPLE 27

Dyeing or printing of PE/Cotton with disperse and Reactive Dyestuffs compared to Invention

| Typical Process | Invention |
|---|---|
| Pretreatment | |
| Desizing | Desizing |
| Caustic Extraction | Not required |
| Bleaching | Bleaching |
| Washing | Washing |
| Drying | Drying |
| Dyeing | |
| Pad Disperse eyes | Pad dyestuffs and cross-linking agent, etc. |
| Dry | Dry |
| Heatfix, say 60 sec. 215° C. | Heatfix say 3–4 min. 170° C. or 5–60 sec. 190° C.–210° C. or HT steam say 10–15 mins. at185° C. |
| Reduction clear (hydrosulphite/caustic) | Not required |
| Wash | Not required |
| Dry | Not required |
| Repad with Reactives | Not required |
| Fix | Not required |
| Wash | Not required |
| Dry | Not required |
| Printing | |
| Not practical - generally non reproduceable results | Highly practical - reproduceable results, since both fibres coloured with same colourant |

TABLE II

EXAMPLE OF ELEGANT PROCESS SEQUENCES

For dyeing a ground shade on P/C 50/50 lightweight bed sheeting, followed by printing and resin finishing:

A. 1. Pad ground shade with invention and dry (e.g. infra red pre-dry followed in one operation of cylinder or hot flue drying).

2. Print with invention or pigments; dry in one operation.

3. Apply crease-resist resin by foam and fix ground shade, prints, and resin in one operation, say at 190° C., 15–17 seconds.

B. 1. Prepad colour/invention plus crease resist resin, e.g. Fixapret COC from the same bath, dry.

2. Print with invention or conventional pigment paste.

3. Heat fix ground shade, resin and print in one stenter pass.

TABLE I

| CONTINUOUS DYEING OR PRINTING OF PE/COTTON | | | | |
|---|---|---|---|---|
| PRETREATMENT | CONVENTIONAL PIGMENTS SYSTEMS | CELLESTREN | DISPERSE/VAT | INVENTION |
| Desizing | yes | very necessary | yes | yes |
| Caustic Extraction | optional | very necessary | desirable | no advantage known |
| Bleaching | yes | yes | yes | yes |
| Washing | yes | yes | yes | yes |
| Drying | yes | yes | yes | yes |
| Dyeing: | | | | |
| Pad Dyestuffs | Helizarin | Cellestren | Palanil Indanthren | wide selection, except cationic |
| Dry | yes | yes | yes | Optional. Can be combined with heat fixation |
| Fix Dyestuffs | Dry heat: 215° C. | Dry heat: 215° C. 30 seconds | Dry heat, 190° C. 30–45 seconds | 5–7 seconds |
| | HT-steam, 175° C., 15 min. | HT steam 180° C. 15 minutes | | |
| Repad Chemicals e.g. Hydro Caustic | No | No | Yes | No |
| Pad Steam Fix say 60 min. 102° C. | No | No | Yes | No |
| Rinse, oxidise, soap, rinse | No | Remove Glyecin* (fixing agent) CD and unfixed residues by washing | Yes | No |
| Dry | No | Yes | Yes | No |
| Printing | Similar | Similar - Glyezin CD can be added to print paste | Similar, but Flash Ager necessary | Similar |

TABLE III

Chemical Glossary of Trade Marks

TABLE III

Chemical Glossary of Trade Marks

| Product | Cas* No. | Description |
|---|---|---|
| 1. Lutexal HP | 26100-47-0 | ammonium acrylate, polymer with acrylamide $(C_3H^5NO)_x$ $(C_3H_4O_2H_3N)_x$ |
| | 64742-96-7 | solvent naphtha (petroleum) heavy aliphatic (mf not specified) |
| | 104376-61-6 | 1,2,3-propanetriol, polymer with (chloromethyl) oxirane and oxirane,momo-9-octadecenyl ether,(Z) |
| | 37295-87-1 | isononylphenol, ethoxylated (water) $(C_2H_4O)_nC_{15}H_{24}O$ |
| 2. Acrisint 311 | 9003-1-4 | acrylic acid, homopolymer $(C_3H_4O_2)_x$ |
| 3. Eulysin WP | 3002-18-4 | triethanolamine triacetate $C_{12}H_{21}NO_6$ |
| 4. Primasol AMK | 25085-02-3 | acrylamide, polymer with sodium acrylate $(C_3H_5NO.C_3H_4O_2.Na)_x$ |
| | 25987-30-8 | acrylic acid, polymer with acrylamide, sodium salt $(C_3H_5NO.C_3H_4O_2)_{x\cdot x}Na$ |
| 5. Luprintol PE | 82471-42-9 | poly(oxy-1,2-ethanediyl), α-2-(2,4-DI=methyl-phenoxy)-1-(2,4-dimethyl-phenoxy)=methyl ethyl,-w-hydroxy- (mf not specified) |
| 6. Helizarin Brill. Pink BT | 1047-16-1 | C.I.** pigment violet 19 |
| Aqueous preparation based on: | 22094-93-5 | C.I. pigment yellow 081 |
| | 6358-30-1 | C.I. pigment violet 23 |
| 7. Siloxane 200/12500 to 200/1000 | 63148-62-9 | Siloxanes and silicones, di-Me. |
| 8. Luwipal 066 | 3089-11-0 | 1,3,5,-triamine, N,N,N',N',N'',N'' hexamethoxy-methyl melamine |
| Cymel 303 | | hexakis (methoxymethyl)- $C_{15}H_{30}N_6O_6$ |
| Setamol WS | 9084-06-4 | napthalenesulfonic acid, polymer with formaldehyde sodium salt $(C_{10}H_8O_3S.CH_2O)_x.xNa$ |
| Ortolan B Brown 3R | | C.I. acid brown 33 |
| Cellestren Yellow 5G Liquid | 64611-92-3 | Butanamide,N—(2,4-dimethoxyphenyl)-3-oxo-2-[[2-(3-phenyl-1,2-4-oxadiazol-5-yl)phenyl]A20] |
| Helizarin Red GR | 6535-46-2 | C.I. pigment red 112 (aqueous preparation of) |

*Chemical Abstracts System

**Colour index as published by: Society of Dyers and Colourists U.K. and American Association of Textile Chemists and Colourists.

The claims defining the invention are as follows:

1. A process for direct coloring of textile fibers, which process comprises (a) applying to conventionally pretreated fibers a coloring mixture comprising a cross-linking agent consisting essentially of a solution of a water insoluble partially precondensed hexamethoxymethyl melamine, said partially precondensed hexamethoxymethyl melamine having 30–50% of said melamine in precondensed form, in a $C_{4-8}$ glycol;

one or more non-cationic colorants; and one or more acid donors; and (b) drying and fixing the fibers.

2. A process for dyeing textile fibers, which process comprises (a) applying to conventionally pretreated fibers a dye liquor comprising a cross-linking agent consisting essentially of a solution of a water insoluble partially precondensed hexamethoxymethyl melamine, said partially precondensed hexamethoxymethyl melamine having 30–50% of said melamine in precondensed form, in a $C_{4-8}$ glycol;

one or more non-cationic colorants; and one or more acid donors; and (b) drying and fixing the fibers.

3. The process of claim 2 wherein the textile fibers are 100% cellulosic fibers or blends thereof with synthetic fibers.

4. The process of claim 2 wherein the amount of melamine is 5–80 g/l of dye liquor, and the amount of glycol is 5–120 g/l of dye liquor.

5. The process of claim 2 wherein the acid donor is one or more saturated aliphatic C4–6 dicarboxylic acids.

6. The process of claim 2 wherein the drying and fixing are effected in one step.

7. The process of claim 6 wherein the drying and fixing step is effected at a temperature of 150°–210° C. for a period of 5 sec–4 min.

8. The process of claim 2 wherein the dye liquor further includes a pigment binder comprising a dispersion of cross-linked polymers of acrylic acid ester, acrylonitrile, acrylic acid, N-methylol methyl acrylamide or mixtures thereof in an amount of 10 to 100 g/l relative to the dye liquor.

9. A process for the direct printing of textile fibers, which process comprises (a) applying to conventionally pretreated fibers a print paste comprising a cross-linking agent consisting essentially of a solution of a water insoluble partially precondensed hexamethoxymethyl melamine, said partially precondensed hexamethoxymethyl melamine having 30–50% of said melamine in precondensed form, in a $C_{4-8}$ glycol;

one or more non-cationic colorants; and one or more acid donors; and (b) drying and fixing the fibers.

10. The process of claim 9 wherein the textile fibers are 100% cellulosic fibers or blends thereof with synthetic fibers.

11. The process of claim 9 wherein the amount of melamine is 5–80 g/kg of print paste, and the amount of glycol is 5–120 g/kg of print paste.

12. The process of claim 9 wherein the acid donor is a high molecular weight acrylic acid polymer or acrylic acid/acrylamide copolymer.

13. The process of claim 12 wherein the amount of acid donor is 1–100 g/kg of print paste.

14. The process of claim 9 wherein the $C_{4-8}$ glycol is selected from the group consisting of 2-methyl-butane-1,4-diol, butane-1,2-diol, butane-1,3-diol, butane-1,4-diol, butane-2,3-diol, hexane-2,5-diol, pentane-1,5-diol, neopentyl glycol, 2-methylpentane-2,4-diol, 2-methylpentane-1,5-diol, and hexane-1,6-diol.

15. The process of claim 9 wherein the drying and fixing are effected in one step.

16. The process of claim 15 wherein the drying and fixing step is effected at a temperature of 150°–210° C. for a period of 5 sec–4 min.

17. The process of claim 9 wherein the print paste further includes a pigment binder comprising a dispersion of cross-linked polymers of acrylic acid ester, acrylonitrile, acrylic acid, N-methylol methyl acrylamide or mixtures thereof in an amount of 10 to 100 g/l relative to the print paste.

18. A textile fiber coloring mixture which mixture comprises:

a non-cationic colorant;

an acid donor; and a cross-linking agent consisting essentially of a water insoluble partially precondensed hexamethoxymethyl melamine, said partially precondensed hexamethoxymethyl melamine having 30–50% of said melamine in precondensed form, dissolved in a $C_{4-8}$ glycol.

19. A dye liquor comprising:

(a) one or more non-cationic colorants;

(b) one or more acid donors; and (c) a cross-linking agent comprising a solution of a water insoluble partially precondensed hexamethoxymethyl melamine, said partially precondensed hexamethoxymethyl melamine having 30–50% of said melamine in precondensed form, in a $C_{4-8}$ glycol.

20. The dye liquor of claim 19 wherein the acid donor comprises one or more saturated aliphatic $C_{4-6}$ dicarboxylic acids.

21. The dye liquor of claim 20 wherein the dicarboxylic acid is selected from the group consisting of succinic acid, glutamic acid, adipic acid, or mixtures thereof.

22. The dye liquor of claim 19 wherein said $C_{4-8}$ glycol is selected from the group consisting of 2-methyl-butane-1,4-diol, butane-1,2-diol, butane-1,3-diol, butane-1,4-diol, butane-2,3-diol, hexane-2,5-diol, pentane-1,5-diol, neopentyl glycol, 2-methylpentane-2,4-diol, 2-methylpentane-1,5-diol and hexane-1,6-diol.

23. The dye liquor of claim 19 wherein the melamine and glycol are present in amounts of 5 to 80 g/l and 5 to 120 g/l, respectively, relative to the dye liquor.

24. The dye liquor of claim 23 wherein the melamine and glycol are present in amounts of 10 to 50 g/l and 15 to 50 g/l, respectively, relative to the dye liquor.

25. The dye liquor of claim 19 wherein said acid donor is present in an amount of 1 to 5 g/l relative to the dye liquor.

26. The dye liquor of claim 19 further comprising a pigment binder of cross-linked copolymers of acrylic acid ester, acrylonitrile, acrylic acid, N-methylol methyl acrylamide, or mixtures thereof, in an amount of 10 to 100 g/kg relative to the dye liquor.

27. A print paste comprising (a) one or more non-cationic colorants, (b) one or more acid donors; and (c) a cross-linking agent comprising a solution of a water insoluble partially precondensed hexamethoxymethyl melamine, said partially precondensed hexamethoxymethyl melamine having 30–50% of said melamine in precondensed form, in a $C_{4-8}$ glycol.

28. The print paste of claim 27 wherein the acid donor is selected from the group consisting of acrylic acid polymers and acrylic acid acrylamide copolymers.

29. The print paste of claim 27 wherein said $C_{4-8}$ glycol is selected from the group consisting of 2-methyl-butane-1,4-diol, butane-1,2-diol, butane-1,3-diol, butane-1,4-diol, butane-2,3-diol, hexane-2,5-diol, pentane-1,5-diol, neopentyl glycol, 2-methylpentane-2,4-diol, 2-methylpentane-1,5-diol and hexane-1,6-diol.

30. The print paste of claim 27 wherein the amounts of melamine and glycol are in the ranges of 5 to 80 g/kg and 5 to 120 g/kg respectively, relative to the print paste.

31. The print paste of claim 30 wherein the amounts of melamine and glycol are in the ranges of 10 to 50 g/kg and 15 to 50 g/kg respectively, relative to the print paste.

32. The print paste of claim 27 wherein the acrylic acid polymer is present in an amount in the range of 10 to 100 g/kg relative to the print paste.

33. The print paste of claim 27 further comprising a silicone or vegetable oil, and, optionally, urea.

34. The print paste of claim 33 wherein said silicone oil is in the range of 1000 to 15,000 cps.

35. The print paste of claim 33 wherein said silicone oil and said urea, if present, are used in an amount in the range of 1 to 100 g/kg.

36. The print paste of claim 27 further comprising a pigment binder of cross-linked copolymers of acrylic acid ester, acrylonitrile, acrylic acid, N-methylol methyl acrylamide, or mixtures thereof, in an amount of 10 to 100 g/kg relative to the print paste.

37. A cross-linking agent for use in combination with a colorant to obtain a dye liquor or print paste comprising a solution of a water insoluble partially precondensed hexamethoxymethyl melamine, said partially precondensed hexamethyl melamine having 30–50% of said melamine in precondensed form, in a $C_{4-8}$ glycol.

38. The cross-linking agent of claim 37 wherein said $C_{4-8}$ glycol is selected from the group consisting of 2-methyl-butane-1,4-diol, butane-1,2-diol, butane-1,3-diol, butane-1,4-diol, butane-2,3-diol, hexane-2,5-diol, pentane-1,5-diol, neopentyl glycol, 2-methylpentane-2,4-diol, 2-methylpentane-1,5-diol and hexane-1,6-diol.

39. A cross-linking agent for use in combination with a pigment to obtain a print paste said cross-linking agent comprising a solution of a water insoluble technical partially precondensed hexamethoxymethyl melamine, said partially precondensed hexamethoxymethyl melamine having 30–50% of said melamine in precondensed form in a $C_{4-8}$ glycol, along with a silicone or vegetable oil.

40. The cross-linking agent of claim 39 wherein said silicone oil is in the range of 1000 to 15,000 cps.

* * * * *